United States Patent [19]

Vermeulen

[11] Patent Number: 4,810,993

[45] Date of Patent: Mar. 7, 1989

[54] ADJUSTABLE ELECTROMECHANICAL COMPONENT

[75] Inventor: Freddy J. Vermeulen, Roeselare, Belgium

[73] Assignee: U.S. Philips Corp., New York, N.Y.

[21] Appl. No.: 905,812

[22] Filed: Sep. 9, 1986

[30] Foreign Application Priority Data

Sep. 19, 1985 [NL] Netherlands ..... 8502563

[51] Int. Cl.[4] ..... H01C 10/32

[52] U.S. Cl. ..... 338/162; 338/160; 338/167

[58] Field of Search ..... 338/160, 161, 162, 163, 338/164, 165, 166, 167, 168, 169, 170, 312

[56] References Cited

U.S. PATENT DOCUMENTS 2,749,416 6/1956 Steele ..... 338/168

3,537,056 10/1970 Van Benthuysen et al. ... 338/312 X

*Primary Examiner*—E. A. Goldberg

*Assistant Examiner*—M. M. Lateef

*Attorney, Agent, or Firm*—F. Brice Faller

[57] ABSTRACT

An electromechanical component, in particular a rotary potentiometer having an integrated center click or optionally more fixed intermediate positions. The fixed intermediate position is obtained by a combination of two teeth and a lug. The two teeth are integrated with the element of the resistance path and the lug with the element having the contact members of the component.

4 Claims, 1 Drawing Sheet

ADJUSTABLE ELECTROMECHANICAL COMPONENT

BACKGROUND OF THE INVENTION

The invention relates to an electromechanical component which is adjustable by rotation, in particular a rotary potentiometer, but also a rotary switch or a function switch, consisting of an element having a resistance path or at least two contact pads and an element which is movable with respect thereto and comprises one or more contact members and one or more intermediate positions fixed by means of position indication.

U.S. Pat. No. 4,344,063 describes a rotary potentiometer having a separate spring and a plate comprising a recess with which an intermediate position is obtained.

In comparison with a rotary potentiometer without this provision this component is much more complicated and in series production requires extra steps in the mechanization.

SUMMARY OF THE INVENTION

It is the object of the invention to provide such an electromechanical component which is considerably simpler in structure and can be manufactured without expensive extra provisions in the machinery.

The position indication consists of the combination of two teeth present on the side of the element with the contact members and integrated with the element with the resistance path or the contact pads and a lug fitting between the teeth and integrated with the other element.

According to the most usual embodiment the element with the resistance path or to the contact pads consists of a housing having a substrate for its sealing plate on which the resistance path or the contact pads and the required connection lugs are present. The element with the contact members in that case is constructed as a rotor.

The two functions, that of the element with the resistance path or the contact pads, and that of the element with the contact member or the contact members, may, of course, be changed kinematically in known manner.

The element with the resistance path or with the contact pads, or in the second embodiment the housing, is usually manufactured by injection moulding. In comparison with an element belonging to the construction without position indication, a matrix may be used which can simply be derived from the original matrix. The same applies to the other element and the rotor, respectively, a part of which may also consist of a synthetic resin and may be manufactured by injection moulding. When the rotor is punched from metal the provision of a lug in this special embodiment does not require great adjustments in the machine in question.

According to a special embodiment on which higher requirements are imposed, the lug integrated with the rotor may consist of a combination of a ball with a compression spring.

DETAILED DESCRIPTION OF THE PREFERRED EMBODIMENT

Figure 3:
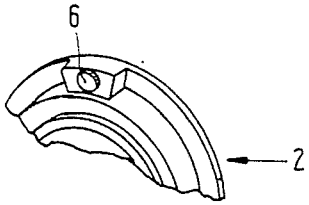
FIG. 3 is a partial rear perspective of the rotor.
Figure 1:
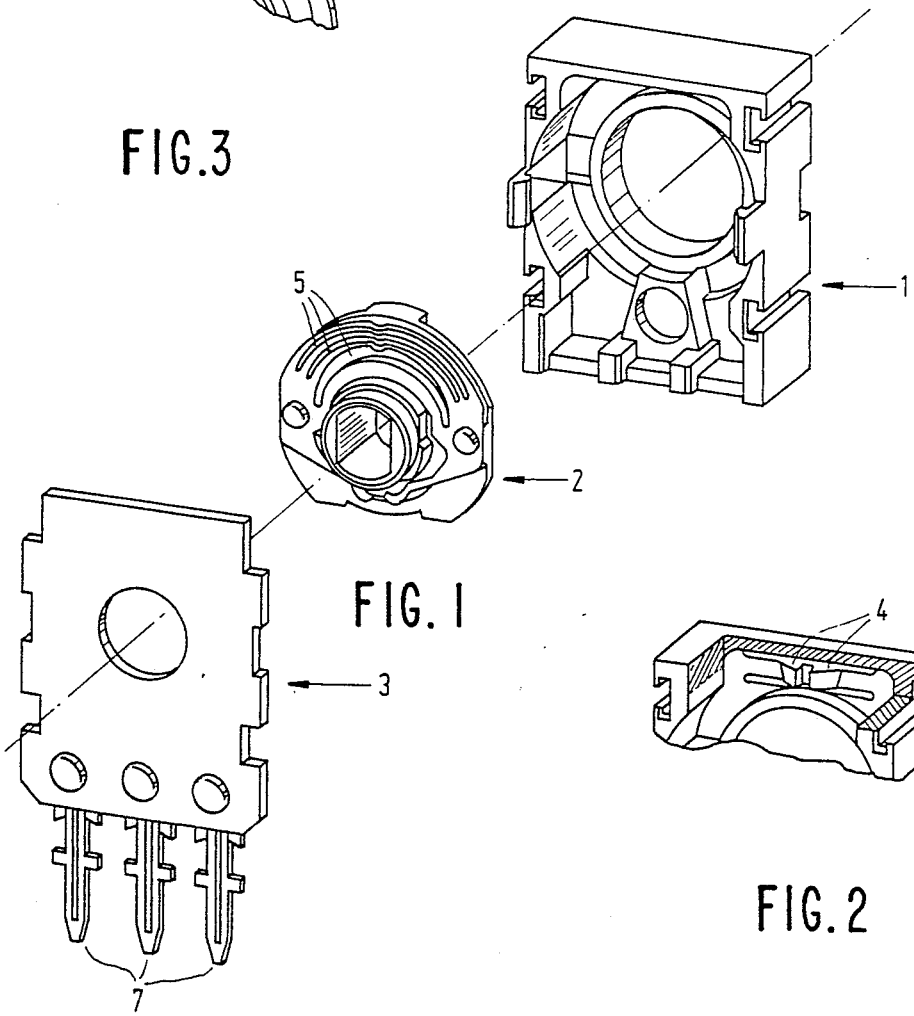
FIG. 1 is an exploded perspective of a rotary potentiometer according to the invention.
Figure 2:
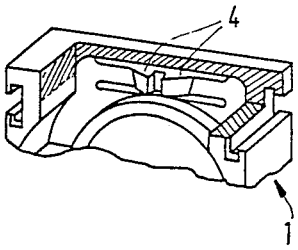
FIG. 2 is a cut-away partial perspective of the housing.

The housing is denoted by 1; 2 is the rotor and 3 is the sealing plate of the housing which also forms the substrate and on which the resistance path is present on the rear side, hence not visible in the drawing. The sealing plate comprises connection lugs 7. The shaft with the bearing bush is not shown. A part of the housing 1 is shown in FIG. 2 with the upper edge cut away so that the two teeth 4 which represent a part of the invention are visible. On the rear side of housing 1 a bearing bush for the rotary shaft is provided, if so desired. The metal contact with take-off contacts 5 is present on the rotor 2. A part of the rotor is shown in the rear view in FIG. 3 so that the lug 6 which forms the other part of the invention is visible. The rotor 2 on which the contacts 5 are secured is also manufactured from a synthetic resin in the embodiment shown in the drawing.

The rotary potentiometer is preferably constructed so that the direction in which the lug 6 presses against the teeth 4 is parallel to the rotor shaft. Placing the lug and teeth on the circumference of the rotor 2 would have the disadvantage that the bearing of the potentiometer experiences a transverse load resulting in greater detrition.

What is claimed is:

1. An electromechanical component which is adjustable by rotation comprising:

an element having a resistance path or at least two contact pads, and a pair of side-by-side teeth, a rotor movable with respect to said element by rotating about an axis of rotation through said element, said rotor having one or more take-off contacts and a lug, said lug fitting between said teeth to provide position indication at a predetermined intermedined angular position.

2. An electromechanical component as in claim 1 wherein said lug extends substantially parallel to the axis of rotation of the rotor.

3. An electromechanical component as in claim 1 wherein said element comprises a housing and a sealing plate fixed thereto, said sealing plate having said resistance path or contact pads thereon, and connection lugs extending therefrom.

4. An electromechanical component as in claim 3 wherein said teeth are molded integrally with said housing.

* * * * *